US005561963A

United States Patent [19]

Sytema et al.

[11] Patent Number: 5,561,963

[45] Date of Patent: Oct. 8, 1996

[54] APPARATUS AND METHOD FOR PREPARING SETS OF DOCUMENTS TO BE MAILED

[75] Inventors: Herman Sytema, Terhorne; Gerhard Hidding, Heerenveen, both of Netherlands

[73] Assignee: Hadewe B.V., Drachten, Netherlands

[21] Appl. No.: 578,752

[22] Filed: Dec. 26, 1995

Related U.S. Application Data

[63] Continuation of Ser. No. 175,553, Dec. 30, 1993, abandoned.

[30] Foreign Application Priority Data

Dec. 31, 1992 [NL] Netherlands ..... 9202296

[51] Int. Cl.[6] ..... B65B 57/00

[52] U.S. Cl. ..... 53/55; 53/493; 53/117; 53/504

[58] Field of Search ..... 53/55, 493, 498, 53/504, 447, 460, 429, 473, 117, 569, 284.3, 540, 495, 498, 500, 504, 505

[56] References Cited

U.S. PATENT DOCUMENTS

| | | | |
|---|---|---|---|
| 3,692,302 | 9/1972 | Porups | 53/495 |
| 4,338,768 | 7/1982 | Ballestrazzi | 53/495 |
| 4,524,557 | 6/1985 | Silverman et al. | 53/55 |
| 4,627,222 | 12/1986 | Cantile . | |
| 4,903,456 | 2/1990 | Meur . | |
| 4,939,676 | 7/1990 | Worsley et al. | 271/258 |
| 5,029,832 | 7/1991 | Orsinger et al. | 53/498 |
| 5,042,223 | 8/1991 | Gerbaud . | |
| 5,067,305 | 11/1991 | Baher et al. | 53/55 |
| 5,295,677 | 3/1994 | Hutner | 271/265 |
| 5,339,603 | 8/1994 | Gombault et al. | 53/117 |

FOREIGN PATENT DOCUMENTS

| | | | |
|---|---|---|---|
| 0317932 | 5/1989 | European Pat. Off. . | |
| 0460329 | 12/1991 | European Pat. Off. . | |
| 3735974 | 11/1986 | Germany . | |
| 385245 | 5/1990 | Italy | 53/498 |
| 2201403 | 9/1988 | United Kingdom . | |
| WO90/14632 | 11/1990 | WIPO . | |

*Primary Examiner*—John Sipos
*Assistant Examiner*—Ed Tola
*Attorney, Agent, or Firm*—Burns, Doane, Mathis, Mathis, L.L.P.

[57] ABSTRACT

An apparatus for preparing sets of documents comprises a document conveyor, a shunting station, a folding station, and a controller. A scanner determines the length of the conveyed documents in a set or the space between successive documents sets. The control acts responsive to the determined length or space, and adjusts the cycle speed of the apparatus so that the documents sets are conveyed with a minimum of intervening space without colliding. The invention also includes a method for controlling the apparatus of the invention.

9 Claims, 1 Drawing Sheet

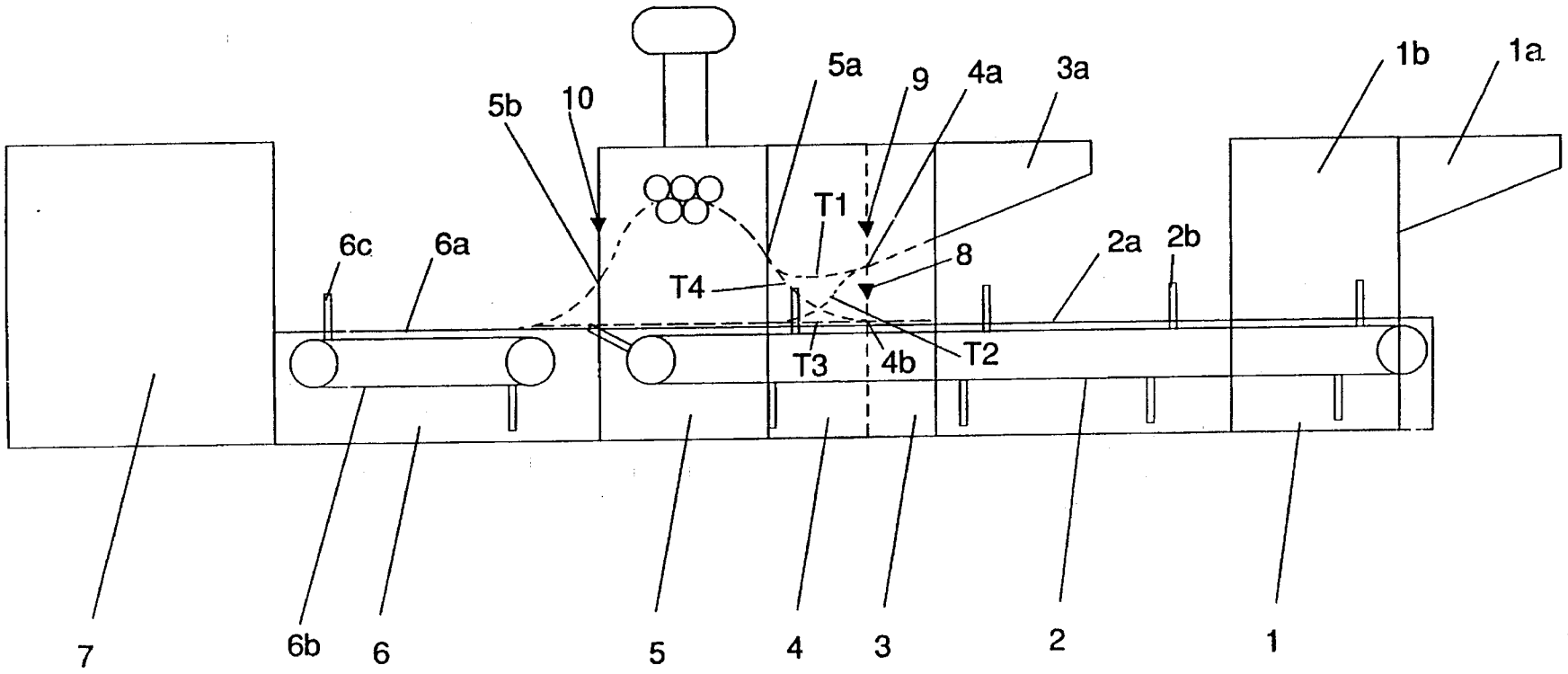
1a
1b
1
2b
2a
2
3a
4a
8
T2
9
4b
3
5a
T1
T3
4
T4
5
10
5b
6a
6
6c
6b
7

APPARATUS AND METHOD FOR PREPARING SETS OF DOCUMENTS TO BE MAILED

This application is a continuation of application Ser. No. 08/175,553, filed Dec. 30, 1993, abandoned.

BACKGROUND AND SUMMARY OF THE INVENTION

This invention relates to an apparatus for preparing sets of documents, comprising a folding station, supply means for supplying document sets each consisting of at least one document in spaced succession to the folding station, and control means for controlling the supply means and the folding station.

It is known to use such an apparatus for the purpose of assembling items to be mailed, whereby the documents supplied by the supply means are folded using a folding station and dispensed for further processing. Such an apparatus is known in particular as a configuration possibility of components which are marketed and manufactured by HADEWE B.V. of Drachten, the Netherlands, under the designation "System 7". In the known apparatuses for processing documents the documents are fed to the folding station at a specified fixed interval to prevent the documents from colliding with each other in the folding station or upon leaving the folding station. With a view to operating convenience, in the known apparatus the interval is the same for every processing situation. The fixed interval is therefore generally tailored to the longest document to be processed. This means the interval is tailored to the most unfavorable processing situation, with the result that the apparatus as a whole has a rather low processing speed.

It is one object of the present invention to provide an apparatus without the above-mentioned drawback.

To realize this object, in accordance with the invention, an apparatus of the type described in the preamble is equipped with measuring means for determining a length of a document set or of a space between two successive document sets supplied to the folding station, these measuring means being operatively connected to the control means, the control means being adapted for controlling the supply means such that documents are supplied to the folding station without colliding with preceding documents and with a minimum of interspace.

Such an apparatus, while its operating convenience is maintained, ensures an optimum processing speed of the documents without the documents colliding with each other.

The measuring means can for instance be designed with scanning means comprising a photocell. Such a photocell is a standard commercially available device and is highly reliable in operation.

The known apparatus moreover typically comprises an accumulating position arranged behind the folding station. The accumulating position generally comprises a stop and discharge means. The drawback of the known apparatus with an accumulating position is that the supply means feeding the documents to the folding station and the discharge means of the accumulating position are coupled to each other. In the known apparatus the supply and discharge means are for instance designed as a single endless chain or belt conveyor, so that the supply and discharge of the documents always takes place simultaneously. The folding station is essentially arranged over the conveyor. The associated drawback is that when the conveying means is operated to convey a document, the accumulating position is emptied, one result being that it is impossible to form behind the folding station a stack composed of documents which have been folded in two stages by the folding station. Moreover, coupling the supply means and the discharge means has a retarding effect on the total apparatus. The fact is that when the discharge cannot take place immediately, for instance because apparatus arranged behind the accumulating position is not yet ready for processing documents, the supply is delayed too.

To remove this drawback, in accordance with a further elaboration of the invention an accumulating station is arranged behind the folding station, this accumulating station comprising a stop adapted to be positioned automatically and freely relative to a reference point, and discharge means drivable and controllable independently of the supply means.

Such an "uncoupled" accumulating station has a favorable effect on the processing speed and the processing possibilities of the apparatus. By virtue of the free and automatic positioning of the stop, the accumulating station can process documents of different sizes without requiring manual adjustment activities for this purpose.

For the purpose of supplying documents of mutually highly different lengths, the use of only one supply means may cause unnecessary delay because the processing speed of the entire apparatus is tailored to the longest document to be processed. In order to reduce these unnecessary delays to a minimum, it is particularly advantageous, in accordance with a further elaboration of the invention, if the apparatus comprises a shunting station, the supply means comprising one or more first feeder stations, a conveying means and a second feeder station, the first feeder stations each being designed for feeding documents to the conveying means, the second feeder station being designed for feeding documents directly to the shunting station, the conveying means being designed for feeding documents to the shunting station, the shunting station being designed for feeding documents to both the folding station and the accumulating station.

The term "feeder station" as used herein is understood to mean any station adapted for feeding documents intended for an item to be mailed, for instance a printer, a burster, a feeder station for feeding singulated sheets from a stack or a crossfolding machine for folding a document in longitudinal direction.

The documents fed to the shunting station by the conveying means and the second feeder station can traverse the shunting station along intersecting paths. The timing by which the documents are fed to the shunting station both by the second feeder station and by the conveying means must be such that any documents crossing each other in the shunting station will not collide with each other. Whether the documents collide with each other in the shunting station depends on the length of the documents that are being fed by the second feeder station and the conveying means and on the route which the documents traverse through the shunting station. In some cases it may happen that certain feeder stations do not feed any documents or that, for instance, the documents coming from the second feeder station do not have to be folded. Because of all these possible combinations there are about 300 possible modi in which the apparatus can function. Each mode requires a particular processing speed of the total apparatus.

Precisely in such complex apparatus where at different points collisions between documents can occur, i.e. in the folding station, the shunting station and during the feeding of documents to the conveying means and the shunting station, the advantage achieved through the scanning means and the particular control, i.e., that, while the operating convenience is maintained, the processing speed is adjusted to the instantaneous mode of the apparatus, carries particular great weight, since the processing speed is automatically adjusted to the instantaneous mode of the apparatus without intervention on the part of the operator. Moreover, in the case of such complex apparatus, the separate accumulating station provides the advantage of greater freedom in the choice of the order in which the documents are fed to the shunting station, since now, in contrast with the known apparatus, it is quite well possible that documents located in the second feeder station are the first to be fed to the shunting station.

A constructively and control-technically simple design of such an accumulating station can comprise, in accordance with a further elaboration of the invention, a supporting surface comprising at least one slot extending in the direction of conveyance, at least one endless belt or chain arranged under the supporting surface and extending in the direction of the slot, this belt or chain being drivable in two directions and controllable to be stopped in any position, the belt or chain comprising fingers or similar elements reaching through the slot to above the supporting surface and fulfilling the functions of both stop and discharge means.

Because the fingers function both as stop and as discharge means, the accumulating station need only comprise one driving motor for driving the discharge means and positioning the stop.

According to a further elaboration of the invention, an inserter device may be arranged behind the accumulating station, this inserter device being adapted for inserting a stack supplied by the accumulating station to the inserter device into an envelope, the inserter device and the accumulating station being coupled in such a manner that the stop is positioned relative to the reference of the accumulating station in accordance with the size of the envelope disposed in the inserter device.

Such a design provides a secure positioning of the stop since the documents to be accumulated have a size such that they fit into the envelope.

According to an alternative elaboration of the invention, the control can be designed such that the positioning of the stop is at least dependent on the length of the documents as measured by the scanning means.

The length of the documents as measured by the scanning means could moreover be used for choosing the correct envelope in the inserter device. It holds for this embodiment, too, that the positioning of the stop is securely effected.

The present invention further relates to a method for controlling the apparatus according to the invention.

The known apparatus is so controlled that it functions appropriately for all possible modi. In the known apparatus, the processing speed of the different components, which is the same for all modi, is selected such that for the most unfavorable mode the documents do not collide with each other. In practice, this unfavorable mode rarely occurs. For the other modi the processing speed selected is in essence too low. Accordingly, it holds in practice that the processing speed of the total apparatus is generally lower than would be possible in the mode used.

It is an object of the invention to provide a method without this drawback.

To realize this object, the method is characterized in that the control initially controls at least the supply means at an initial cycle speed, the scanning means measuring the length of document sets or of an interspace between the successive documents, and the control subsequently increases the cycle speed of the apparatus, in such a manner that the interspace between the successive documents is minimized.

Such a method for controlling the apparatus provides an optimum processing speed without detracting from the operating convenience of the apparatus.

To clarify the invention, the method and an exemplary embodiment of the apparatus will now be described with reference to the accompanying drawings.

DETAILED DESCRIPTION OF A BEST MODE OF THE INVENTION

The drawing shows a schematic side elevation of an exemplary embodiment of the apparatus according to the invention. The exemplary embodiment shown comprises one first feeder station 1. Naturally, the apparatus may comprise several first feeder stations. A feeder station 1 may be designed as a feeder station for feeding singulated sheets from a stack, a printer, a burster, a crossfolding machine or a similar document-feeding station. In the exemplary embodiment shown the first feeder station is designed as a feeder station comprising a document supply holder 1*a* and a feeder part 1*b*. The feeder part 1*b* has an exit connecting to a conveying means 2. The conveying means 2 comprises a supporting surface 2*a* comprising two longitudinal slots (not shown) through which fingers 2*b* extend to above the supporting surface 2*a*. The fingers 2*b* serve to advance documents disposed on the supporting surface. The fingers 2*b* are connected with a drivable endless chain or belt 2*c* which can be stopped in any position. Downstream of the first feeder station 1, at the end of the conveying means 2, a second feeder station 3, a shunting station 4 and a folding station 5 are arranged. The construction of the shunting station 4 and the conveying means 2 can for instance be based on the construction of a transport section for a mail processing machine, as marketed by HADEWE B.V. of Drachten, the Netherlands, under the designation "TR2". Only one specimen of the second feeder station 3 is present for all possible embodiments. In the exemplary embodiment the second feeder station 3 is designed as a feeder station for singulated supply. The second feeder station 3 moreover comprises an integrated shunting station 4. The second feeder station 3 feeds the documents stored in the document-supply holder 3*a* directly to an upper entrance 4*a* of the shunting station 4. In the shunting station 4 the documents supplied by the second feeder station 3 are passed either to the entrance 5*a* of the folding station or under the folding station 5 to the conveying means 2. In the first case the documents follow the path indicated by the reference character T1 and in the second case the documents follow the path T2. The documents coming from the first feeder station 1 are passed via the conveying means 2 to the lower entrance 4*b* of the shunting station 4. In the shunting station 4 the documents can either be passed under and past the folding station 5 and accordingly be simply conveyed further on the conveying means 2, or to the entrance 5*a* of the folding station 5. The documents which are passed under the folding station 5 follow the path T3 and the documents that are passed to the entrance 5*a* of the folding station 5 follow the path T4. The documents which have entered the folding station 5 via entrance 5*a* and thus have passed the folding mechanism thereof are passed via the exit 5*b* to the accumulating station 6. The documents which have been passed via path T2 or path T3 under the folding station 5 are passed to the accumulating station 6 via the conveying means 2.

The accumulating station 6 shown comprises a supporting surface 6*a* comprising at least one slot (not shown) extending in the conveying direction of the conveying means 2. Under the supporting surface 6*a*, the accumulating station 6 comprises a drivable endless chain or belt 6*b* comprising at least one finger 6*c*. The finger 6*c* extends through the slot to above the supporting surface 6*a*. The drivable chain or belt 6*b* can be stopped in any desired position. The fingers 6*c* connected to the belt or chain 6*b* fulfill the function of stop as well as of discharge means.

Downstream of the accumulating station 6 the exemplary embodiment shown further comprises an inserter device 7. The documents which have been accumulated in the accumulating station 6 against a finger 6*c* functioning as stop, can, if the stack is complete, be discharged to the inserter device 7 using the discharge means 6*c*, which in this exemplary embodiment are also formed by the fingers 6*c*.

The exemplary embodiment moreover comprises a number of scanning means 8, 9, 10 for determining the length and the size of the interspace between the successive documents. The scanning means 8, 9, 10 are arranged at the entrances 4*a* and 4*b* of the shunting station 4 and at the exit 5*b* of the folding station 5.

At the start-up of the processing of a new series of documents the processing speed of the total apparatus is so low that the documents, independently of the length thereof, cannot anywhere collide with each other. The interspace between the successive documents will in this phase be generally fairly large because the processing speed is tuned to the slowest possible mode of the apparatus when processing documents of maximum length. During the first processing cycles of the series, scanning means 8, 9, 10 determine the interspace between the documents. These measurements are passed on to the control and the control increases the processing speed in accordance with these measurements such that the interspace between the documents is minimized without giving rise to the risk of collisions in the shunting station 4. Thus, after a number of processing cycles, the best possible processing speed is obtained for a given processing mode and document length without intervention of the operator.

The scanning means 8, 9, 10 moreover determine the length of the documents and pass the information on to the control. The control can determine what position the stop 6*c* of the accumulating station 6 should take up on the basis of the length of the documents as measured by the scanning means 8, 9, 10, and optionally in combination with the setting of the folding station 5. The length of the documents as measured by the scanning means 8, 9, 10 can moreover be used in the inserter device 7 for selecting a correct envelope.

According to an alternative elaboration it is possible that the operator sets the size of the envelope at the inserter device 7 and that the control determines the position to be taken up by the stop 6*c* depending on the size of the envelope.

It will be clear that the invention is not limited to the exemplary embodiment described and that various modifications thereof are possible within the framework of the invention.

Thus, the apparatus may for instance comprise several first feeder stations, a different type of folding station and other processing stations may be arranged upstream or downstream of the inserter device.

We claim:

1. An apparatus for preparing sets of documents, comprising:

supply means for supplying document sets in spaced succession and at a controllable variable cycle speed, each document set consisting of at least one document;

a folding station downstream of the supply means for processing successively each document set supplied by the supply means at a cycle speed responsive to the controllable cycle speed of the supply means;

measuring means for determining a length of a space between two successive document sets folded in the folding station; and control means operatively connected to the measuring means and to the supply means for increasing the delivery rate of the supply means so that successive document sets are supplied to the folding station without colliding and the measured length of the space between two successive document sets is minimized.

2. An apparatus according to claim 1, wherein the measuring means comprise scanning means comprising a photocell.

3. An apparatus according to claim 1, comprising an accumulating station downstream of the folding station, the accumulating station comprising a supporting surface, a stop for stopping documents moving on the supporting surface in a conveying direction, the stop being movable between positions on the supporting surface in the conveying direction, and discharge means operable independently of the supply means.

4. An apparatus according to claim 3, comprising a shunting station, the supply means comprising conveying means for conveying document sets to the shunting station, at least one first feeder station for feeding documents to the conveying means and a second feeder station between the at least one first feeder station and the shunting station for feeding document sets directly to the shunting station, the shunting station connected to the folding station and the conveying means for delivering document sets to both the folding station and the accumulating station.

5. An apparatus according to claim 3, wherein the supporting surface of the accumulating station has at least one slot disposed in the conveying direction, and both the stop and the discharge means each comprise fingers attached to at least one endless belt or chain extending parallel to the slot under the supporting surface, the belt or chain being selectably drivable in opposite directions relative to the slot for positioning at any position along the slot, wherein the fingers extend from the belt or chain through the slot above the supporting surface.

6. An apparatus according to claim 3, comprising an inserter device downstream of the accumulating station and adapted for inserting documents supplied by the accumulating station into an envelope, the inserter device and the accumulating station being operatively interconnected for positioning the stop relative to the reference point in accordance with the size of an envelope supplied to the inserter device.

7. An apparatus according to claim 3, wherein the measuring means are adapted for also measuring the length of a document set and the control means are adapted for positioning the stop in accordance with the length of a document set measured by the measuring means.

8. A method for controlling an apparatus for preparing sets of documents, said apparatus comprising a folding station, supply means for supplying document sets each consisting of at least one document in spaced succession to the folding station, and measuring means for measuring an interspace between successive document sets, comprising the steps of:

initially controlling at least the supply means for supplying document sets to the folding station at an initial cycle speed, folding document sets in the folding station, measuring a length of an interspace between successive folded document sets, and subsequently controlling at least the supply means for supplying document sets at an increased cycle speed responsive to measured lengths of interspaces between successive document sets until the interspace between the successive document sets is minimized.

9. An apparatus for preparing sets of documents, comprising:

supply means for supplying document sets in spaced succession and at a controllable variable cycle speed, each document set consisting of at least one document, the supply means comprising conveying means, at least one first feeder station for feeding documents to the conveying means and a second feeder station downstream of the at least one first feeder station;

a folding station downstream of the supply means for processing successively each document set supplied by the supply means at a cycle speed responsive to the controllable cycle speed of the supply means;

an accumulating station downstream of the folding station;

a shunting station connected to the folding station and the conveying means for delivering document sets selectably to one of the folding station and the accumulating station, the second feeder station connected to feed document sets directly to the shunting station, the conveyor connected for conveying document sets from the first feeder station to the shunting station;

measuring means mounted at the shunting station for determining a length of a document set or of a space between two successive document sets supplied to the shunting station; and control means operatively connected to the measuring means and to the supply means for controlling the supply means so that successive document sets are supplied to the shunting station without colliding and with a minimum space between document sets.

* * * * *